United States Patent [19]

Abthoff et al.

[11] 4,098,252

[45] Jul. 4, 1978

[54] METHOD AND APPARATUS FOR CARRYING OUT THE METHOD TO CONTROL A MULTI-CYLINDER INTERNAL COMBUSTION ENGINE

[75] Inventors: Jörg Abthoff, Plüderhausen; Hans-Dieter Schuster, Schorndorf; Dag-Harald Hüttebräucker, Weinstadt; Reiner Kreeb; Marijan Laszlo, both of Stuttgart, all of Fed. Rep. of Germany

[73] Assignee: Daimler-Benz Aktiengesellschaft, Fed. Rep. of Germany

[21] Appl. No.: 779,993

[22] Filed: Mar. 22, 1977

[30] Foreign Application Priority Data

Mar. 23, 1976 [DE] Fed. Rep. of Germany ..... 2612172

[51] Int. Cl.[2] ..... F02D 17/00

[52] U.S. Cl. ..... 123/198 F; 123/32 EA

[58] Field of Search ..... 123/198 F, 139 E, 32 EA, 123/139 AZ

[56] References Cited

U.S. PATENT DOCUMENTS

| | | | |
|---|---|---|---|
| 2,166,968 | 7/1939 | Rohlin | 123/198 F X |
| 2,875,742 | 3/1959 | Dolza | 123/198 F X |
| 3,741,685 | 6/1973 | Simko | 123/198 F X |
| 3,756,205 | 9/1973 | Frost | 123/198 F X |
| 3,911,872 | 10/1975 | Hughes | 123/139 E X |

*Primary Examiner*—Charles J. Myhre
*Assistant Examiner*—Ira S. Lazarus
*Attorney, Agent, or Firm*—Craig & Antonelli

[57] ABSTRACT

A method and apparatus for controlling a multi-cylinder internal combustion engine by connecting or disconnecting one or several of the cylinders with a throttling device provided in the suction system of the internal combustion engine; simultaneously with the connection or disconnection of the cylinder or cylinders, the position of the throttling device is so changed jump-like that the output of the internal combustion engine remains essentially unchanged.

20 Claims, 3 Drawing Figures

METHOD AND APPARATUS FOR CARRYING OUT THE METHOD TO CONTROL A MULTI-CYLINDER INTERNAL COMBUSTION ENGINE

The present invention relates to a method and to an apparatus for carrying out the method for the control of a multi-cylinder internal combustion engine by effectively engaging or disengaging one or several cylinders by means of a throttling device provided in the suction system of the internal combustion engine.

Such a method and such an apparatus are disclosed, for example, in the German Offenlegungsschrift No. 2,255,350, with a multi-cylinder internal combustion engine having one fuel-piston pump per cylinder, whereby individual piston pumps are adapted to be shut-off, i.e., rendered inoperable. Such a method and such an apparatus entailed the principal disadvantage that during the engagement and disengagement of the cylinders, the internal combustion engine produces an output jump, even when according to this known apparatus the fuel quantity supplied by the piston pumps is relatively small during the shutting-off of the piston pumps in comparison to the pump capacity. This output jump, however, is not acceptable in particular with an internal combustion engine installed into a motor vehicle. Also, in the known installation, the shifting point for the shutting-off of the piston pumps is to be dependent on the position of a drive pedal and on the rotational speed of the internal combustion engine which requires a considerable expenditure.

The present invention is concerned with the task to control the internal combustion engine with slight expenditures in such a manner by the engagement or disengagement of cylinders, i.e., by the connection or disconnection thereof, that output jumps of the internal combustion engine are avoided.

The underlying problems are solved according to the present invention in that simultaneously with the engagement or disengagement of the cylinder or cylinders, the position of the throttle device is changed jump-like in such a manner that the output of the internal combustion engine remains essentially unchanged.

The method according to the present invention makes it possible that the output of the internal combustion engine is continuously variable also when an individual output factor is changed jump-like by the engagement or disengagement of cylinders. Further advantages of the present invention reside in that all operating cylinders can always have the same output and that the connecting or disconnecting operation can take place, in principle, at every output of the internal combustion engine.

In one installation for carrying out the method in accordance with the present invention having a throttling device rotatably supported in a suction pipe of a multi-cylinder internal combustion engine, on whose pivot shaft a lever is secured outside of the suction pipe, consists of a selectively actuatable pivotal member with at least two entrainment members offset to one another in the circumferential direction, of which each entrainment member during a pivoting of the pivotal member rotates successively the throttling device by engagement at the lever, whereas during a jump of the lever from one entrainment member to the next entrainment member, the position of the throttling device changes jump-like, and of contacts arranged on the pivotal member and actuated by the pivotal movement thereof, which simultaneously with each jump of the lever from one entrainment member to the next control the engagement or disengagement of the cylinder or cylinders, i.e., the connection and disconnection thereof.

This installation according to the present invention requires only a very small expenditure since only the pivotal member together with the entrainment members has to be installed into the customary control linkage combustion engine, on which are located at the same time the contacts for the control of the engagement or disengagement of the cylinder or cylinders, whence, on the one hand, the advantage of a slight expenditure for this control installation results and, on the other, it is assured that the jump-like adjustment of the throttling device and the engagement or disengagement of the cylinder or cylinders takes place always simultaneously.

Accordingly, it is an object of the present invention to provide a method and apparatus for controlling a multi-cylinder internal combustion engine which avoids by simple means the aforementioned shortcomings and drawbacks encountered in the prior art.

Another object of the present invention resides in a method and apparatus for controlling a multi-cylinder internal combustion engine in which substantially no output jump of the internal combustion engine occurs when one or several cylinders are effectively turned on or shut off for purposes of driving the vehicle.

A further object of the present invention resides in a method and apparatus for carrying out the method to control a multi-cylinder internal combustion engine which is relatively simple in construction, involves relatively little expenditures and is highly reliable in operation.

Still another object of the present invention resides in a method and apparatus for controlling internal combustion engines in which all operating cylinders have always the same output while the connection or disconnection of the cylinders can take place, in principle, at every output of the internal combustion engine.

These and other objects, features and advantages of the present invention will become more apparent from the following description when taken in conjunction with the accompanying drawing which shows, for purposes of illustration only, one embodiment in accordance with the present invention, and wherein.

Figure 1:
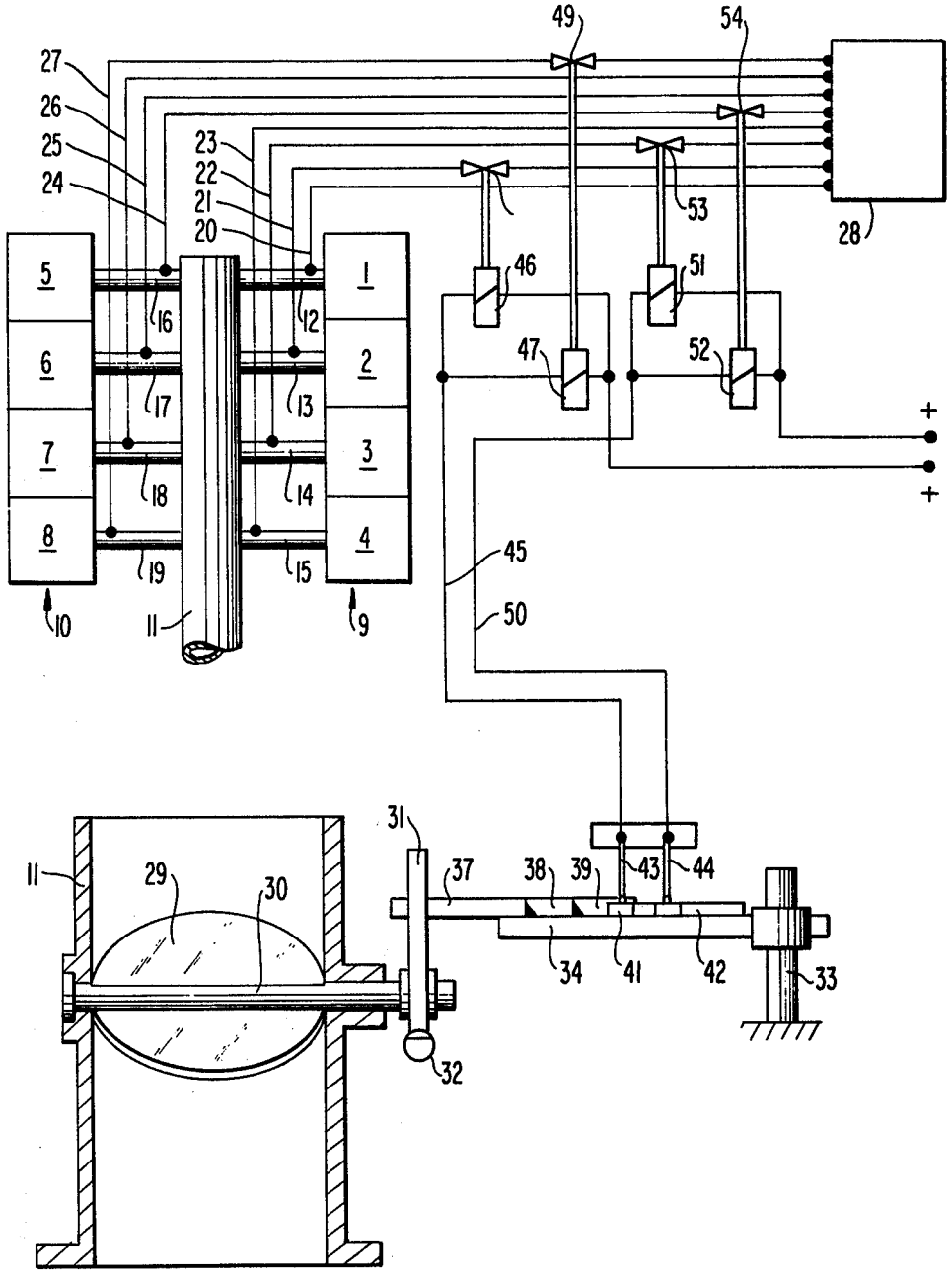
FIG. 1 is a schematic side elevational view of an installation in accordance with the present invention.

Referring now to the drawing wherein like reference numerals are used throughout the various views to designate like parts, and more particularly to FIG. 1, this figure illustrates an eight-cylinder internal combustion engine of V-arrangement whose two cylinder blocks generally designated by reference numerals 9 and 10 having the cylinders 1 to 8 are schematically illustrated. Combustion air is supplied to the cylinders 1 to 8 by way of a common suction pipe 11 and by way of individual suction pipes 12 to 19, whereby one suction pipe 12 to 19 is provided for a respective one of the eight cylinders 1 to 8. Fuel is injected separately into the suction pipes 12 to 19 by way of eight separate injection lines 20 to 27 which are fed from piston pumps (not shown) of a conventional fuel injection pump 28.

A throttling device 29 constructed as throttle valve is arranged in the suction pipe 11 which is illustrated in the closed position. The throttling device 29 is supported on a pivot shaft 30, whereby a lever 31 is secured on the pivot shaft 30 outside of the suction pipe 11. A drawspring 32 engaging at the lever 31 seeks to keep the throttling device 29 in the closed position.

Figure 2:
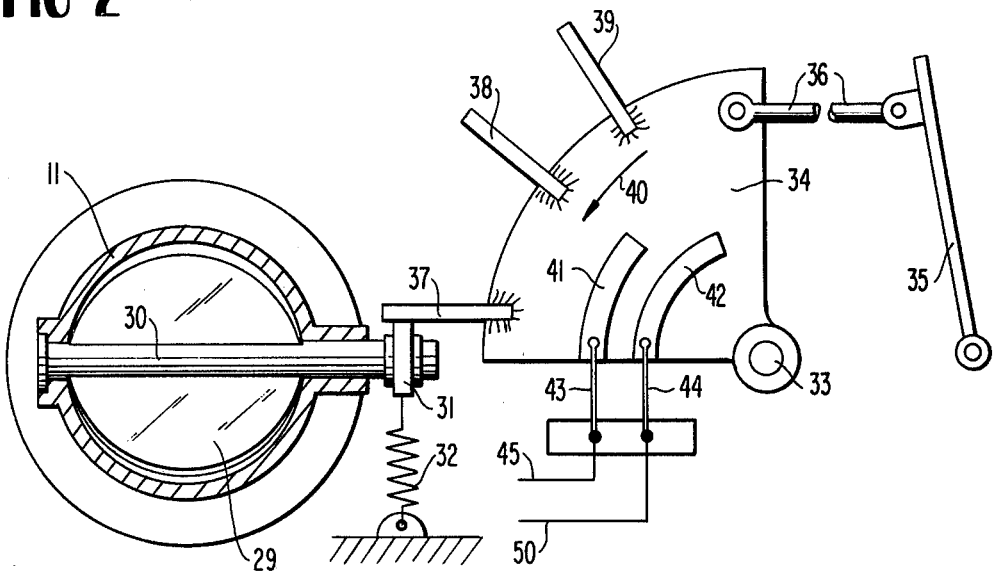
FIG. 2 is a schematic plan view on the installation according to FIG. 1.

A pivotal member 34 in the form of a segmental plate is pivotally supported on a shaft 33, which can be selectively actuated by way of a pedal 35 (FIG. 2), for example, the drive pedal of a motor vehicle, and by way of a linkage 36. Three entrainment members 37, 38 and 39 which are offset to one another in the circumferential direction and are constructed as rods are welded to the pivotal member 34. The entrainment members 37, 38 and 39 engage sequentially at the lever 31 during a pivot movement of the pivotal member 34 in the direction of the arrow 40 and open the throttling device 29. The length of the lever 31 is thereby so selected that when the entrainment member 37 has rotated the throttling device 29 into the fully opened position, the lever 31 is released by the entrainment member 37 and the throttling device 29 is rotated back by the drawspring 32 in the direction toward the closing position. The lever 31 thereby abuts at the entrainment member 38 which has such a distance from the entrainment member 37 that the throttling device 29 is partly opened at the instant of the abutment of the lever 31 at the entrainment member 38. During a further pivoting of the pivotal member 34 in the direction of the arrow 40, the throttling device 29 is again rotated into the fully opened position where the lever 31 is then released by the entrainment member 38. The drawspring 32 rotates the throttling device 29 back in the direction toward the closing position until the lever 31 abuts at the third entrainment member 39. The distance of the entrainment member 39 from the entrainment member 38 is so determined that the throttling device 29 at the instant of the abutment of the lever 31 at the entrainment member 39 remains far reachingly opened, i.e., has a larger opening angle than at the instant of the abutment of the lever 31 at the entrainment member 38. The most favorable values for these two opening angles will be explained more fully hereinafter. During a further pivot movement of the pivotal member 34 in the direction of the arrow 40, the throttling device 29 is now rotated by the entrainment member 39 until it reaches the fully open position.

Two slide surfaces 41 and 42 are electrically conductively arranged on the pivotal member 34 concentrically to the shaft 33, on which slides one sliding contact 43 and 44 each. The length of the slide surface 41 is thereby so determined that an electrical contact between the slide surface 41 and the sliding contact 43 exists only between the end-position of the pivotal member 34 illustrated in FIG. 2 and the position thereof at the instant of the release of the lever 31 by the entrainment member 37. Correspondingly, an electrical contact exists between the slide surface 42 and the sliding contact 44 only between the last described end position and the position of the pivotal member 34 at the instant of the release of the lever 31 by the entrainment member 38. The sliding contact 43 is connected by way of an electric line 45 with two electromagnets 46 and 47 which control two valves 48 and 49 in the injection lines 21 and 27. The valves 48 and 49 are thereby closed when current flows in the line 45, i.e., the cylinders 2 and 8 supplied with fuel by way of the injection lines 21 and 27 are therefore effectively disconnected or disengaged at that time. The slide contact 44 is correspondingly connected by way of an electric line 50 with two electromagnets 51 and 52 which control two valves 53 and 54 in the injection lines 22 and 24. The injection lines 22 and 24 are closed by the valves 53 and 54 when current flows in the line 50, i.e., the cylinders 3 and 5 supplied with fuel by way of the injection lines 22 and 24 are therefore effectively disconnected or disengaged at that time.

The internal combustion engine thus operates only with four cylinders 1, 4, 6 and 7 as long as the throttling device 29 is actuated exclusively by the entrainment member 37. The entire output range of these four cylinders 1, 4, 6 and 7 from idling to full load can thereby be utilized at will. When the lever 31 jumps from the entrainment member 37 to entrainment member 38, the two cylinders 2 and 8 are added, i.e., are effectively connected or engaged so that the internal combustion engine then operates with the six cylinders 1, 2, 4, 6, 7 and 8. The aforementioned opening angle, which the throttling device 29 assumes at the instant of the abutment of the lever 31 at the entrainment member 38, is thereby so selected that the output of the internal combustion engine during six-cylinder operation at this instant is equal or nearly equal to the full-load output of the internal combustion engine with four-cylinder operation. After full-load is reached in the six-cylinder operation, the lever 31 jumps over from the entrainment member 38 to the entrainment member 39 and the two remaining cylinders 33 and 35 are added, i.e., are additionally connected or engaged to render the same operable. The opening angle, which the throttling device 29 assumes at the instant of the abutment of the lever 31 at the entrainment member 39, is so selected that the output of the internal combustion engine in the eight-cylinder operation at this instant is equal or nearly equal to the full-load output of the internal combustion engine in the six-cylinder operation. In the ranges of the transitions from the four-cylinder operation to the six-cylinder operation and from the six-cylinder operation to the eight-cylinder operation thus no output jumps occur, hence with a continuous movement of the drive pedal 35, the output of the internal combustion engine increases continuously.

Figure 3:
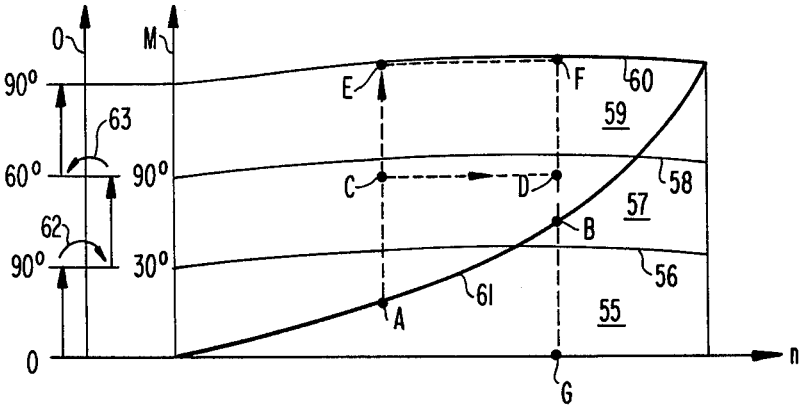
FIG. 3 is a diagram showing the interrelationship of torque as a function of rotational speed, in which the method according to the present invention for an internal combustion engine installed into a motor vehicle is schematically illustrated.

FIG. 3 illustrates schematically how an internal combustion engine which is controlled in such a manner can be utilized in a motor vehicle. The torque M of the internal combustion engine is thereby plotted as a function of the rotational speed *n* thereof. In addition to the torque M, the respective opening angle O of the throttling device 29 is indicated in FIG. 3. The range 55 of the four-cylinder operation of the internal combustion engine is delimited in the upward direction by the full-load curve 56, the range 57 of the six-cylinder operation by the full-load curve 58 and the range 59 of the eight-cylinder operation by the full-load curve 60. Furthermore, a driving resistance curve 61 is also indicated in the diagram of FIG. 3.

If the vehicle is to be accelerated from the point A located on the driving resistance curve 61 within the range 55 of the four-cylinder operation to the point B in the range 57 of the six-cylinder operation, then the driver has the choice whether he will be satisfied with the torque of the internal combustion engine with two turned-off or disconnected cylinders or whether he will utilize the torque of the entire internal combustion engine. In the former case, he displaces the drive pedal 35 so far that the point C is reached within the range of the six-cylinder operation, whereby the throttling device 29 during the transition from four-cylinder to six-cylinder operation jumps back from an opening angle of 90° to an opening angle of 30° as indicated by the arrow 62. The internal combustion engine then accelerates up to the desired rotational speed at the point D from which the point B is reached by a simple back-adjustment of the throttling device 29. In the second case, the full load curve 60 of the range of the eight-cylinder operation is reached at point E, whereby the throttling device 29 jumps back twice, and more particularly at first, as in the first case, during the transition from the four-cylinder to the six-cylinder operation from an opening angle of 90° to an opening angle of about 30° and then during the transition from the six-cylinder to the eight-cylinder operation from the opening angle 90° to an opening angle of about 60° as indicated by the arrow 63. The point F with the desired rotational speed is then reached on the full load curve 60, from which the point B is attained by the retraction or release of the drive pedal 35. In order to prevent that one of two entrainment members 37 and 38 thereby abuts at the lever 31 from behind, it can either be prescribed that at first the drive pedal 35 will be taken back or retracted up to its base position, i.e., at first the point G and then only to point B will be controlled at, or that the lever 31 is provided with a unilaterally acting joint (not shown) of any conventional construction which permits the lever 31 to bend or buckle in case of a load from behind by one of the entrainment members 37 or 38.

In lieu of the illustrated injection system, of course, also any other injection system may be used in the present invention. The valves 48 and 49 can be constructed as closure valves or as three-way valves with a return into the return circulation.

While we have shown and described only one embodiment in accordance with the present invention, it is understood that the same is not limited thereto but is susceptible of numerous changes and modifications as known to those skilled in the art and we, therefore, do not wish to be limited to the details shown and described herein but intend to cover all such changes and modifications as are encompassed by the scope of the appended claims.

What we claim is:

1. A method for controlling a multi-cylinder internal combustion engine by connection or disconnection of one or several cylinders, which includes a throttling device provided in the suction system of the internal combustion engine, comprising the step of changing the position of the throttling device jump-like at the same time with the connection or disconnection of the cylinders in such a manner that the output of the internal combustion engine remains essentially unchanged.

2. A method according to claim 1, comprising the step of sequentially actuating the throttling device by at least two entrainment members whereby the operation of the internal combustion engine with a predetermined number of cylinders is coordinated to the actuation by a respective entrainment member.

3. A method according to claim 2, in which the connection or disconnection of the cylinder or cylinders takes place by selectively turning on or off the fuel supply for such cylinders, and controlling the selective turning on and off of the fuel in dependence on the position of the entrainment members.

4. A method according to claim 3, further comprising the steps of rotating the throttling device from a closed position into a substantially open position by the first entrainment member during the pivoting of the entrainment member starting from a zero position, causing the throttling device to jump back into a partially open position by the jumping of a lever connected with the throttling device from the first to the second entrainment member, then rotating the throttling device into the fully open position by the second entrainment member, thereupon causing in the presence of a third entrainment member the throttling device to jump back into a far-reachingly open position by the jumping of the lever to the third entrainment member, and then rotating the throttling device into the fully open position by the third entrainment member.

5. A method according to claim 2, further comprising the steps of rotating the throttling device from a closed position into a substantially open position by the first entrainment member during the pivoting of the entrainment members starting from a zero position, causing the throttling device to jump back into a partially open position by the jumping of a lever connected with the throttling device from the first to the second entrainment member, and then rotating the throttling device into the fully open position by the second entrainment member.

6. A method according to claim 2, further comprising the steps of rotating the throttling device from a closed position into a substantially open position by the first entrainment member during the pivoting of the entrainment members starting from a zero position, causing the throttling device to jump back into a partially open position by the jumping of a lever connected with the throttling device from the first to the second entrainment member, then rotating the throttling device into the fully open position by the second entrainment member, thereupon causing in the presence of a third entrainment member the throttling device to jump back into a far-reachingly open position by the jumpingof the lever to the third entrainment member, and then rotating the throttling device into the fully open position by the third entrainment member.

7. An installation for controlling a multi-cylinder internal combustion engine by effectively connecting or disconnecting at least one cylinder means, comprising throttling means provided in the suction system of the internal combustion engine, characterized by control means for changing the position of the throttling means jump-like substantially simultaneously with the selective connection or disconnection of the cylinder means in such a manner that the output of the internal combustion engine remains essentially unchanged.

8. An installation according to claim 7, characterized by at least two entrainment means for successively actuating the throttling means, the operation of the internal combustion engine with a predetermined number of cylinder means being coordinated to the actuation by a respective entrainment means.

9. An installation according to claim 8, characterized by fuel supply means for respective cylinder means, the selective connection and disconnection of the cylinder means taking place by the selective connection or disconnection of the fuel supply means to the corresponding cylinder means, the connection or disconnection of the fuel supply being controlled by said control means in dependence on the position of the entrainment means.

10. An installation according to claim 9, characterized in that during a movement of the entrainment means out of a zero position the control means is operable in such a manner that the throttling means is operable to be rotated by the first entrainment means from a substantially closed position into a substantially fully open position, thereafter the throttling means is caused to jump back into a partially open position owing to the jump of a lever connected with the throttling means from the first to the second entrainment means, and thereafter the throttling means is again operable to be rotated into the substantially fully open position by the second entrainment means.

11. An installation according to claim 10, characterized in that in the presence of a third entrainment means, as a result of the jump of the lever onto the third entrainment means, the throttling means jumps back from its substantially fully open position into a far-reachingly open position and is then operable to be rotated by the third entrainment means into the fully open position.

12. An installation according to claim 8, characterized in that during a movement of the entrainment means out of a zero position the control means is operable in such a manner that the throttling means is operable to be rotated by the first entrainment means from a substantially closed position into a substantially fully open position, thereafter the throttling means is caused to jump back into a partially open position owing to the jump of a lever connected with the throttling means from the first to the second entrainment means, and thereafter the throttling means is again operable to be rotated into the substantially fully open position by the second entrainment means.

13. An installation according to claim 7, in which the throttling means includes a pivot shaft, and a lever secured to the pivot shaft externally of the suction pipe of the suction system, characterized by a selectively actuatable pivotal means having at least two entrainment means offset with respect to one another in the circumferential direction, each of said entrainment means successively rotating the throttling means by engagement at the lever during the pivoting of the pivotal means, whereas during a jump of the lever from one entrainment means to the next entrainment means, the position of the throttling means changes jump-like, and electrical contact means arranged on the pivotal means and actuated by the pivot movement thereof which simultaneously with each jump of the lever from one entrainment means to the next are operable to control the connection or disconnection of the cylinder means.

14. An installation according to claim 13, characterized in that the contact means are sliding contacts sliding on electrically conductive slide surfaces provided on the pivotal means.

15. An installation according to claim 13, characterized by a first entrainment means which is operable to rotate the throttling means between a substantially closed and a substantially fully opened position, and by a second entrainment means which is operable to rotate the throttling means between a partially opened and substantially fully opened position.

16. An installation according to claim 15, characterized by a third entrainment means which is operable to rotate the throttling means between a far-reachingly opened and a substantially fully opened position.

17. An installation according to claim 16, characterized by a first electrical slide contact means operable by the interruption thereof simultaneously with the jump of the lever between the first and second entrainment means to control at least one valve means operable to selectively turn on and off the fuel supply to corresponding cylinder means.

18. An installation according to claim 17, characterized by a second electrical slide contact means at the pivotal means, said second electrical slide contact means being operable by the interruption thereof simultaneously with the jump of the lever between the second and the third entrainment means to control at least one valve means which is operable to selectively turn on and off the fuel supply to the corresponding cylinder means.

19. An installation according to claim 13, characterized by a first electrical slide contact means operable by the interruption thereof simultaneously with the jump of the lever between the first and second entrainment means, to control at least one valve means operable to selectively turn on and off the fuel supply to corresponding cylinder means.

20. An installation according to claim 19, characterized by a second electrical slide contact means at the pivotal means, said second electrical slide contact means being operable by the interruption thereof simultaneously with the jump of the lever between the second and the third entrainment means to control at least one valve means which is operable to selectively turn on and off the fuel supply to the corresponding cylinder means.

* * * * *